US006513639B1

(12) United States Patent
Bryant et al.

(10) Patent No.: US 6,513,639 B1
(45) Date of Patent: Feb. 4, 2003

(54) COIN ACCEPTOR SECURITY APPARATUS

(76) Inventors: Rocky Zane Bryant, 1913 WCR 32, Big Springs, TX (US) 79720; James Ross Wilcox, 3202 Grandi Rd., Carlsbad, NM (US) 92008

( * ) Notice: Subject to any disclaimer, the term of this patent is extended or adjusted under 35 U.S.C. 154(b) by 83 days.

(21) Appl. No.: 09/828,363

(22) Filed: Apr. 7, 2001

(51) Int. Cl.[7] ..... G07G 3/00
(52) U.S. Cl. ..... 194/202
(58) Field of Search ..... 194/200, 201, 194/202

(56) References Cited

U.S. PATENT DOCUMENTS 3,844,394 A * 10/1974 Hale et al. ..... 194/201
4,264,000 A 4/1981 Burton
4,359,147 A * 11/1982 Levasseur ..... 194/200
5,377,804 A 1/1995 Robirds
5,398,798 A 3/1995 Ericson
5,570,771 A * 11/1996 Jacobs ..... 194/200
5,913,399 A * 6/1999 Takemoto et al. ..... 194/200
6,000,520 A 12/1999 Dillon et al.
6,182,811 B1 * 2/2001 Wei ..... 194/200

* cited by examiner

*Primary Examiner*—Eileen D. Lillis
*Assistant Examiner*—Michael J. Kwon
(74) *Attorney, Agent, or Firm*—Robert W. Harris

(57) ABSTRACT

Security apparatus for preventing deception of a coin acceptor unit by use of a moving magnetic field which a thief may produce by moving a hand magnet near the coin acceptor unit to induce currents in the mechanism's circuitry to cause a false determination that a proper coin has been received and allow unpaid operation of the controlled machinery; said apparatus having circuitry elements to detect a moving magnetic field and upon detection of said field to turn off power needed for operation of the coin acceptor unit and the machinery, and to keep said power off for a predetermined time out period, and to restore the coin acceptor unit to normal settings, allowing normal operation of the coin acceptor unit and machinery after expiration of said time out period, until such time as a moving magnetic field is again detected.

4 Claims, 2 Drawing Sheets

COIN ACCEPTOR SECURITY APPARATUS

BACKGROUND OF THE INVENTION

The invention pertains to security devices to prevent deception of coin acceptor units which allow persons to pay for operation of varied kinds of machinery, such as vending machines, coin operated car washes, and many other kinds of machines which are intended to be operable only upon receipt of proper payment by the coin acceptor unit, and more particularly pertains to prevention of a particular kind of such deception which a thief may cause by exposing the coin acceptor unit to a moving magnetic field.

Though coin acceptor units are of varied kinds, they all have mechanisms and circuitry for allowing operation of some electrically powered machinery if and only if the required payment has been received by the coin acceptor unit. One possible way of interfering with proper operation of the coin acceptor unit, so as to cause it to improperly allow the machinery operation when a proper coin has in fact not been received, is to expose the circuitry of the coin acceptor unit to a moving magnetic field. Even without gaining physical access to the interior components of the coin acceptor unit, the thief may expose the coin acceptor circuitry of the mechanism to a moving magnetic field, by simply moving a strong hand-held magnet near the outside of the case containing the mechanism. By Faraday's law, the moving magnetic field lines will induce currents to flow in the circuitry of the coin acceptor unit.

Applicants have recently become aware that it is becoming increasingly common for thieves to steal operation of coin-operated car wash machines by this magnetic deception method. However, applicants believe that this practice represents a threat to the security of a wide variety of machinery activated through coin acceptor units.

So, there is a need, met by applicants' invention, for a coin acceptor unit security apparatus which will detect the presence of a moving magnetic field, and, upon detection of same, temporarily prevent the flow of the electrical power needed to allow the coin acceptor unit to activate the machinery, for a desired short "time out" period, and which will further, upon expiration of said time out period, automatically restore the coin acceptor unit to its normal settings, so that it may then be used to activate the machinery through deposit of the required coinage, and which will allow said normal settings to be maintained until the next detection of a moving magnetic field. There is further a need for such a security apparatus which may be used to block magnetic deception of any coin acceptor unit.

Applicants' apparatus meets these needs, in its preferred embodiment, by means of circuitry containing a magnetic switch for detection of the moving magnetic field, a timer for controlling the duration of the time out period, and circuitry for controlling timer activation and power interruption and resumption.

SUMMARY OF THE INVENTION

The invention is a security apparatus for preventing deception of a coin acceptor unit used to allow only paid operation of machinery, where such deception is caused by use of a moving magnetic field which a thief may produce by moving a magnet near the coin acceptor unit to induce currents in the mechanism's circuitry so as to cause a false determination that a proper coin has been received and allow unpaid operation of the controlled machinery; said apparatus comprising means to detect a moving magnetic field and further comprising a time out means to, upon detection of said field, turn off power needed for operation of the coin acceptor unit and the machinery, and to keep said power off for a predetermined time out period, and to restore the coin acceptor unit to normal settings, allowing normal operation of the. coin acceptor unit and machinery after expiration of said time out period, until such time as a moving magnetic field is again detected.

DESCRIPTION OF THE PREFERRED EMBODIMENTS

Figure 1:
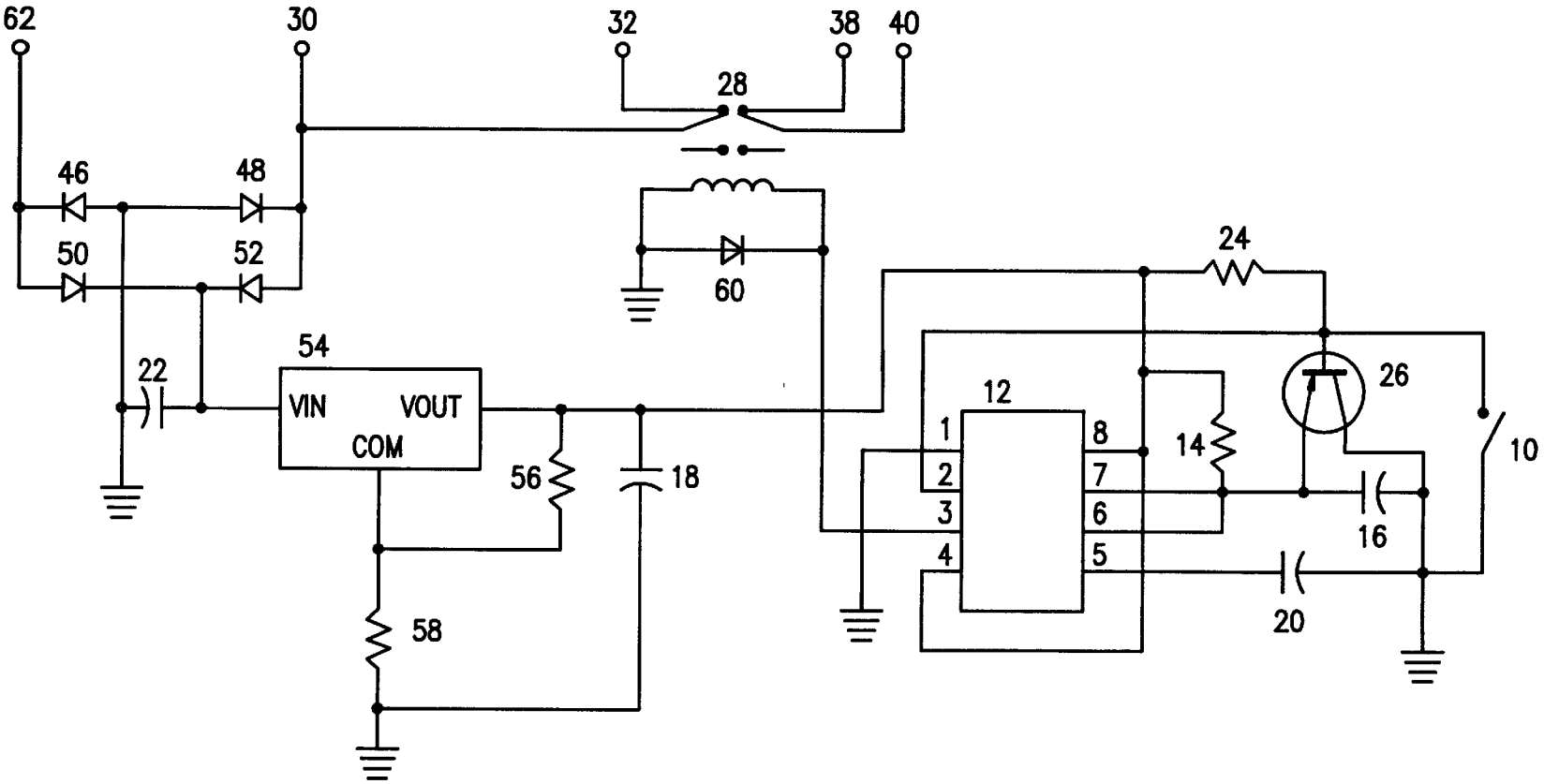
FIG. 1 is a schematic circuit diagram of the preferred embodiment.

Referring now to the drawings, in which like reference numbers denote like or corresponding elements, the elements of the invention itself are schematically shown in FIG. 1. The means to detect a moving magnetic field is a magnetic switch 10, a Hamlin MDCG4-12-33 magnetic switch, which is normally open, but which is momentarily closed upon exposure of magnetic switch 10 to moving magnetic field lines.

The time out means has a timer means in the form of a timer 12, which timer 12 is a 555 timer chip, a National Semiconductor LM555CN timer chip, which starts and ends the time out period initiated upon detection of the moving magnetic field by magnetic switch 10, with the length of the time out period being determined by the RC time associated with the values of resistor 14 and capacitor 16 connected to timer 12 as shown in FIG. 1. The capacitor 16 and capacitor 18 are each 10 $\mu$F 35V capacitors; capacitor 20 is a 0.01 $\mu$F 50 V ceramic disc capacitor; and capacitor 22 is a 100 $\mu$F 50V capacitor. The resistor 24 is a 4.7 K ohm resistor that limits the current flow through magnetic switch 10 and transistor 26. The transistor 26 is a 2N3906 PNP transistor.

The time out means also includes the relay switch 28 and other circuitry shown in FIG. 1, used in carrying out the time out period power interruption upon detection of a moving magnetic field, and also effecting restoration of power at the end of the time out period, as detailed below.

Figure 2:
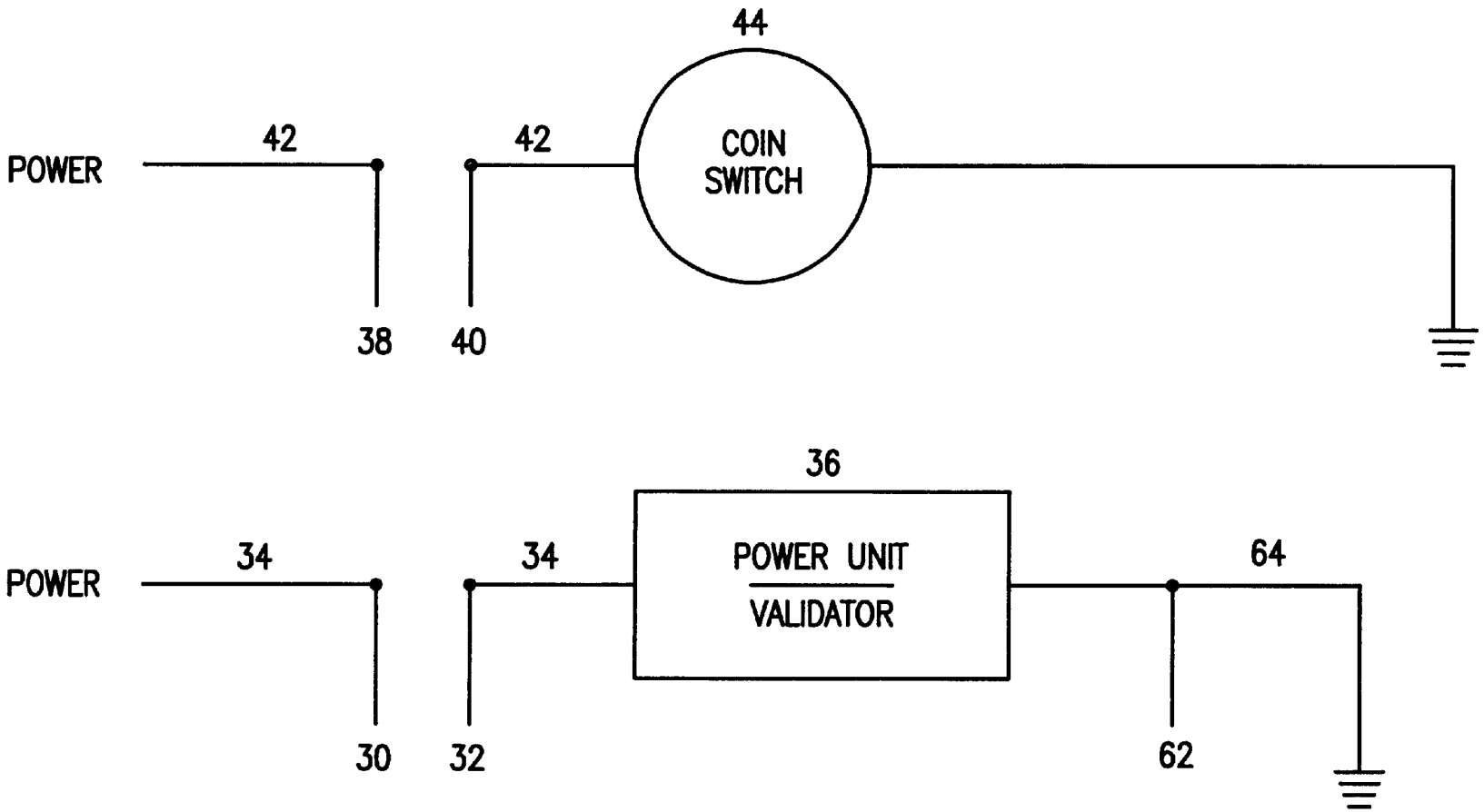
FIG. 2 is a schematic diagram showing the manner of connection of the invention to a typical electronic coin acceptor unit.

As seen from FIGS. 1 and 2, the present invention circuitry is connected across lead 30 and lead 32 of power lead 34 leading to the coin acceptor power unit 36; and is also connected across lead 38 and lead 40 of power lead 42 leading to coin acceptor coin switch 44. As detailed below, the invention operates to open both power lead lines during the time out period, to prevent flow of power to-both coin acceptor power unit 36 and coin switch 44 during the time out period, by opening the circuit of power lead 34, between lead 30 and lead 32, and also opening the circuit of power lead 42, between lead 38 and lead 40, during the time out period.

The principal components of the conventional coin acceptor unit, coin acceptor power unit 36 and coin switch 44, of course have other circuitry connecting them, which is not shown in FIG. 2, since the conventional coin acceptor unit is not part of the present invention shown in FIG. 1, and since the point of FIG. 2 is simply to illustrate, in conjunction with FIG. 1, the manner of connection of the present invention across the power leads of the conventional coin acceptor unit.

With the invention connected to the conventional coin acceptor unit in the manner indicated in FIGS. 1 and 2, the coin acceptor unit works normally, absent exposure to a moving magnetic field, to allow operation of the machinery upon receipt of the required payment by the coin acceptor unit.

But when an attempt is made to deceive the coin acceptor unit, by moving a magnet near the unit so as to expose the unit to a moving magnetic field, the moving magnetic field is detected by the normally open magnetic switch 10, which momentarily closes and thus allows current to flow and activate timer 12, to initiate the time out period. Of course it is important that the invention be employed in close physical proximity to the coin acceptor unit, so that the magnetic switch 10 can detect any moving magnetic field experienced by the coin acceptor unit.

When timer 12 is activated, it energizes the coil in relay switch 28, causing relay switch 28 to open the circuit between lead 30 and lead 32, thus stopping flow of power through power lead 34 to coin acceptor power unit 36. The opening of the relay contacts of relay switch 28 simultaneously opens the circuit between lead 38 and lead 40, thus stopping flow of power through power lead 42 to coin switch 44.

So, immediately after the opening of relay switch 28, power to the coin acceptor unit is totally off, preventing magnetic impulses from activating the coin acceptor unit and thus preventing activation of the machinery controlled by the coin acceptor unit. The power will remain off during the time out period, the duration of which is determined as already described, so that neither the coin acceptor unit nor the machinery it controls may be operated at all during the time out period. Circuit components could be selected to give any desired time out period, usually in the range from 1 millisecond to 30 seconds, depending upon the application.

When the time out period is completed, timer 12 turns off power to the coils of relay switch 28, returning relay switch 28 to its normally closed status. This restores the connection of lead 30 to lead 32, and simultaneously restores the connection of lead 38 to lead 40, thus allowing power to again flow through power lead 34 to coin acceptor power unit 36, and to again flow through power lead 42 to coin switch 44. At this time the time out period has ended, and the coin acceptor unit is restored to normal operation status, allowing deposit of proper coins to activate the controlled machinery.

However, after completion of the time out period, as soon as another attempt is made to deceive the coin acceptor unit by use of a moving magnetic field, the invention circuitry will again be activated as described above, initiating a new time out period during which the coin acceptor unit and the machinery controlled by it may not be operated.

Since the invention circuitry automatically restores the coin acceptor unit to normal operation at the end of each time out period, no reset action is required on the part of the owner, to allow continuing coin operation of the machinery for all times outside the time out periods, and to continuously defeat attempted magnetic deception of the coin acceptor unit. This makes the invention particularly useful for applications to machinery often operated without the owner being present, e.g. coin-operated car wash facilities.

As indicated in FIG. 1, the invention circuit also includes a full bridge AC to DC rectifier, comprising diode 46, diode 48, diode 50, diode 52, and capacitor 22. Since the voltage commonly used to operate electronic coin acceptors is 24 VAC, the rectifier is needed to convert the AC to DC voltage, since DC voltage is required to operate the timer 12 and its supporting circuitry. The circuit also includes a DC voltage regulator, comprising the component 54, a National Semiconductor LM317T 1.5 amp adjustable voltage regulator; a 4.7K Ohm resistor 56; a 560 ohm resistor 58; and capacitor 18; these components combine to make component 54 supply 12 VDC to the rest of the circuit.

The diode 60 is connected across the coil of relay switch 28 in order to prevent current back surges into timer 12.

Lead wire 62 of the invention circuit, FIG. 1, is connected to ground lead wire 64 of the coin acceptor power unit 36, FIG. 2.

When magnetic switch 10 is activated by the moving magnetic field, the transistor 26 is activated and shorts across capacitor 16 starting the time out period and preventing the RC timing circuit from progressing. When magnetic switch 10 is deactivated by removal of the moving magnetic field, transistor 26 no longer shorts across capacitor 16 and the RC timing circuit begins its function. When the RC circuit time has elapsed the time out period ends and power is restored to the coin acceptor unit, coin acceptor power unit 36 and coin switch 44.

Some Possible Variations of Embodiments

Those familiar with the art will appreciate that the invention may be employed in a wide variety of configurations without departing from the essential substance thereof.

For example, and not by way of limitation, although a magnetic switch is used in the preferred embodiment to detect a moving magnetic field, other means might be used instead. Since a moving magnetic field will induce a current to flow in a closed conducting loop, such a loop could be used in conjunction with a current detector to detect moving magnetic field by detecting the current in the loop induced by the moving magnetic field. Or, since a moving magnetic field will induce a voltage across a conductor, where there is no closed loop for current flow, one could detect the moving field by simply measuring the voltage it induces across a non-loop conductor.

Although the applicants have become aware of the problem dealt with by the present invention in connection with coin operated car wash machines, the invention may be employed to prevent moving magnetic field deception of coin acceptors for any coin-operated machinery, e.g. soft drink or food and candy vending machines, juke boxes, slot machines and pinball machines.

Although the preferred embodiment is intended for use with 24 volt coin acceptors, the person of ordinary skill in the art will of course understand that, with suitable modification, application of the invention is not limited to any particular voltage coin acceptor unit.

The scope of the invention is defined by the following claims, including also all subject matter encompassed by the doctrine of equivalents as applicable to the claims.

We claim:

1. Security apparatus for preventing deception of a coin acceptor unit used to allow only paid operation of machinery, where such deception is caused by use of a moving magnetic field which a thief may produce by moving a magnet near the coin acceptor unit to induce currents in the mechanism's circuitry so as to cause a false determination that a proper coin has been received and allow unpaid operation of the controlled machinery; said security apparatus comprising:

means to detect a moving magnetic field; and a time out means to, upon detection of said field, turn off power needed for operation of said coin acceptor unit and said machinery and keep said power off for a predetermined time out period, and, at the end of said time out period, restore said power and restore said coin acceptor unit to normal settings, so as to allow normal operation of said coin acceptor unit and machinery.

2. Apparatus of claim 1, wherein said means to detect a moving magnetic field is a magnetic switch.

3. Apparatus of claim 1, wherein said time out means comprises:

a timer means, connected to said means to detect a moving magnetic field, for starting and ending a time out period of predetermined length upon detection of said moving magnetic field; and switching means, connected to said timer means, for switching off said power during said time out period, and for restoring said power at the conclusion of said time interval.

4. Apparatus of claim 3, wherein said switching means comprises a relay means, connected to said timer means, and circuit means, connected to said relay means, for switching said power off during said time out period, and for turning said power back on at the end of said time out period.

* * * * *